US007076194B2

(12) United States Patent
Asakura

(10) Patent No.: US 7,076,194 B2
(45) Date of Patent: Jul. 11, 2006

(54) DEVELOPING DEVICE AND IMAGE FORMING APPARATUS

(75) Inventor: Kenji Asakura, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/090,793

(22) Filed: Mar. 25, 2005

(65) Prior Publication Data

US 2005/0220503 A1 Oct. 6, 2005

(30) Foreign Application Priority Data

Mar. 29, 2004 (JP) ..... 2004-096057

(51) Int. Cl.
*G03G 15/08* (2006.01)

(52) U.S. Cl. ..... 399/288; 399/265; 399/252

(58) Field of Classification Search ..... 399/252, 399/288, 265, 279, 286, 284
See application file for complete search history.

(56) References Cited

U.S. PATENT DOCUMENTS 4,412,733 A * 11/1983 Doutney ..... 399/288
5,602,632 A * 2/1997 Kuehnle ..... 399/265

FOREIGN PATENT DOCUMENTS

| | | |
|---|---|---|
| JP | 2-221977 A | 9/1990 |
| JP | 6-222657 A | 8/1994 |
| JP | 7-13437 A | 1/1995 |

* cited by examiner

*Primary Examiner*—David M. Gray
*Assistant Examiner*—Ruth N LaBombard
(74) *Attorney, Agent, or Firm*—Nixon & Vanderhye P.C.

(57) ABSTRACT

A developing device includes an endless belt stretched around a plurality of support members, a portion of a peripheral surface of the endless belt contacting a portion of a surface of an image carrying member at a contact region, the endless belt being rotated by a driving force transmitted from a driving device at a driving transmission position, and a layer regulating member pressed against a portion of the endless belt at a pressure contact region positioned upstream, with respect to the endless belt's rotation direction, from the contact region. Further provided is a load device applying, to at least a portion of the endless belt between the pressure contact region and the contact region, which is positioned upstream, with respect to the endless belt's rotation direction, from the driving transmission position, a load acting in a direction opposite to the rotation direction of the endless belt.

16 Claims, 5 Drawing Sheets

DEVELOPING DEVICE AND IMAGE FORMING APPARATUS

CROSS REFERENCE

This Nonprovisional application claims priority under 35 U.S.C. § 119(a) on Patent Application No. 2004-096057 filed in Japan on Mar. 29, 2004, the entire contents of which are hereby incorporated by reference.

BACKGROUND OF THE INVENTION

The present invention relates to developing devices providing a single component developing agent to an image carrier, as well as to image forming apparatuses such as copiers, printers, fax machines and the like provided with such a developing device.

As is disclosed in JP H02-221977A, image forming apparatuses, such as copiers, are provided with a developing device for supplying a single component developing agent (also referred to as "toner" in the following) to an image carrier, in order to develop a static latent image formed on the surface of the image carrier (photosensitive drum).

A developing device 100 in JP H02-221977A, as shown in FIG. 1, includes a developer 101, a toner supply roller 102, a developing roller 103 and a coating blade (layer regulating member) 104. Unused toner T serving as the developing agent is contained inside the developer 101, To supply toner from the developing device 100 to the photosensitive drum 110 of the image forming apparatus, the unused toner T inside the developer 101 is transported to the developing roller 103 by rotating the toner supply roller 102. Then, the toner carried on the surface of the developing roller 103 is transported to a pressure contact region at which the coating blade 104 presses against the developing roller 103. At this pressure contact region, the toner T on the developing roller 103 is regulated to a suitable layer thickness by the coating blade 104 and is subjected to frictional charging, after which it is transported to a contact region where the photosensitive drum 110 contacts the developing roller 103 (developing nip region).

However, with the above-described configuration for regulating the layer thickness using this coating blade, the contact pressure of the coating blade on the development roller is large, so that an excessive load was applied to the toner by the pressure contact region. Therefore, there was the problem that the toner was degraded and the flow properties and charge properties deteriorated.

This leads to a decrease of the toner concentration due to a decrease of the toner amount transported by the roller and image fog or toner scattering due to the supplying of toner that is not properly charged to the contact region, thus decreasing image quality. Moreover, there was also the problem that toner was fused to the contact surface where the coating blade contacts the toner. This leads to white strikes or the like in the image formed on the paper.

To address this problem, it is conceivable to diminish the contact pressure with which the coating blade presses against the development roller, but if this contact pressure is diminished, then it is not possible to form a consistently thin toner layer, and if the toner amount per unit surface area becomes large, then this may lead to scattering of the toner during the development of the static latent image or during transfer onto the recording medium (also referred to below as "paper"), therefore degrading the image quality. In particular in image forming apparatuses with a configuration in which the pigment concentration of the toner is increased to attain a sufficient image density with a small amount of toner, the layer thickness of the toner is very important.

It is thus an object of the present invention to provide a developing device with which a single component developing agent with a layer thickness that is suitable for development can be supplied from the peripheral surface of an endless belt to the surface of an image carrier, while reducing the contact pressure of the layer regulating member pressing against the endless belt. It is also an object of the present invention to provide image forming apparatus provided with such a developing device.

SUMMARY OF THE INVENTION

A developing device in accordance with an embodiment of the present invention includes an endless belt that is stretched around a plurality of support members, a portion of a peripheral surface of the endless belt contacting a portion of a surface of an image carrying member at a contact region, and the endless belt being rotated by a driving force that is transmitted from a driving device at a driving transmission position; and a layer regulating member that is pressed against a portion of the endless belt at a pressure contact region positioned upstream, with respect to the endless belt's rotation direction, from the contact region. A single component developing agent carried on a peripheral surface of the endless belt is supplied to the contact region. The contact region is positioned upstream, with respect to the endless belt's rotation direction, from the driving transmission position. The developing device is further provided with a load device applying, to at least a portion of the endless belt between the pressure contact region and the contact region, a load acting in a direction opposite to the rotation direction of the endless belt.

An image forming apparatus in accordance with the present invention includes the above-described developing device and performs image formation by transferring onto a recording medium a developing agent image obtained by developing a static latent image formed on a surface of an image carrying member.

DESCRIPTION OF THE PREFERRED EMBODIMENTS

First Embodiment

Figure 1:
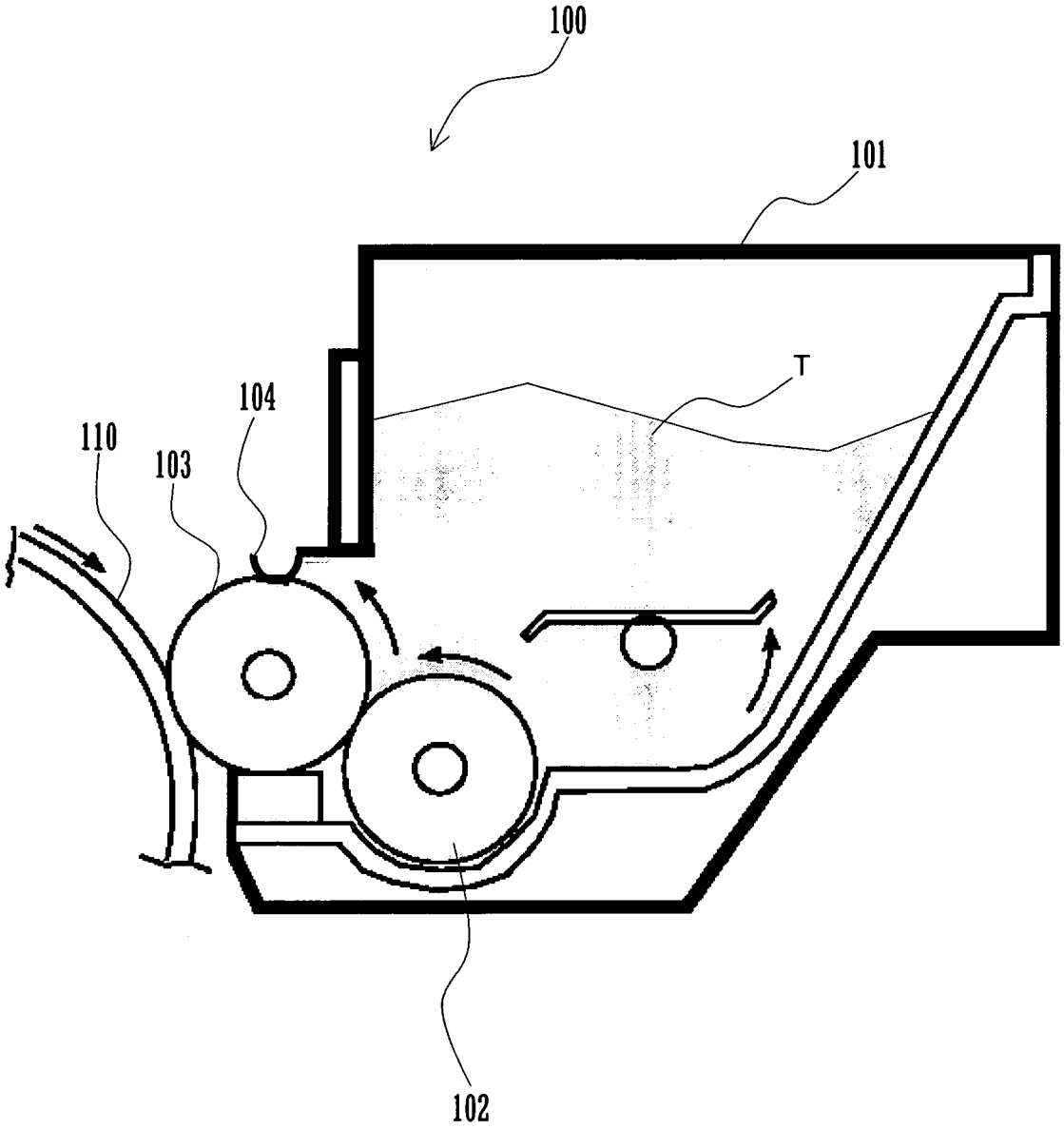
FIG. 1 PRIOR ART
FIG. 1 is a lateral cross-sectional view showing the configuration of a portion of an image forming apparatus provided with a conventional developing device.
Figure 2:
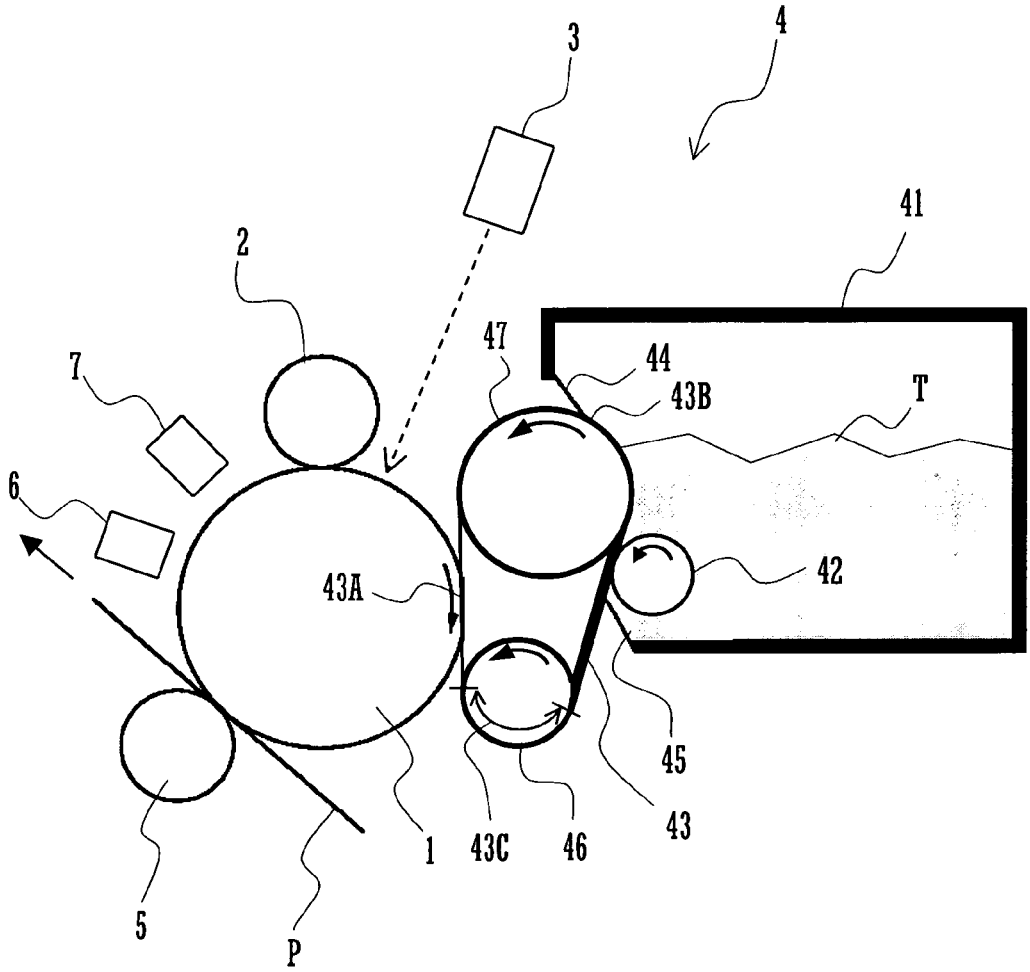
FIG. 2 is a lateral cross-sectional view showing the configuration of a portion of an image forming apparatus provided with a developing device according to an embodiment of the present invention.

FIG. 2 is a lateral cross-sectional view showing the configuration of a portion of an image forming apparatus provided with a developing device according to an embodiment of the present invention. Inside this image forming apparatus, a cylindrical photosensitive drum 1 is provided, which corresponds to an image carrying member in the sense of the present invention. Around this photosensitive drum 1, a charging member 2, an exposure member 3, a developing device 4, a transfer member 5, a cleaning member 6 and a decharging member 7 are arranged in this order.

With this image forming apparatus, a static latent image is formed on the surface of the photosensitive drum 1 based on image information of a read document or image information sent over a network, and this static latent image is developed (made visible) by the developing device 4. Then, the toner image formed through this development is transferred onto a paper P that is transported on a paper transport path between the photosensitive drum 1 and the transfer member 5, thus performing image formation.

The photosensitive drum 1, which revolves in arrow direction as shown in FIG. 2, is made of a bare aluminum tube or the like serving as a conductive base material, on whose surface an organic photosensitive layer is formed and which is connected to ground (GND) potential. The charging member 2 charges the surface (organic photosensitive layer) of the photosensitive drum 1 to a predetermined potential. The exposure member 3, which serves as a writing member, scans the surface of the charged photosensitive drum 1 with light (for example laser light) that is modulated in accordance with the image information, thus forming a static latent image.

The developing device 4 develops the static latent image on the surface of the photosensitive drum 1 using toner T that is carried on the peripheral surface of an endless belt 43. The transfer member 5 transfers the toner image on the surface of the photosensitive drum 1 onto the paper P.

The toner T is an insulating, non-magnetic single-component toner with negative chargeability, having a colorant and a release agent dispersed in a binder resin. The volume average particle size of the toner T is 6.5 μm, its softening point is 100° C., its pigment concentration is 15%, and the content of the wax serving as the release agent is 12%.

As shown in FIG. 2, the developing device 4 is made of a toner hopper 41, a toner supply roller 42, an endless belt (developing belt) 43, a layer regulating blade 44, and a recovery seal 45, for example. The toner hopper 41 contains unused toner T. The toner supply roller 42 rotates in the arrow direction shown in FIG. 2, and at the location where the toner supply roller 42 contacts the peripheral surface of the endless belt 43, it supplies the unused toner T to the endless belt 43. The toner supply roller 42 has a layer of an urethane sponge formed on the surface of a core member.

The endless belt 43 is stretched around, for example, a driving roller 46 and a driven roller 47 that are provided on both sides with flanges for keeping the belt from coming off, and rotates in the arrow direction shown in FIG. 2. The endless belt 43 carries the toner T supplied from the toner supply roller 42 on its peripheral surface, and, as its rotates, transports the toner T to the contact region (developing nip region) where it contacts the photosensitive drum 1.

The endless belt 43 is made by dispersing a conductive material in an elastic material with a width of 330 mm, and a thickness in its free state of 0.2 mm, such as urethane rubber with a Young's modulus of 0.3 MPa having excellent mechanical strength. It should be noted that the material of the endless belt 43 is not limited to rubber materials, and as long as it is a material having elasticity and conductivity, it is also possible to use ethylene propylene rubber, silicone rubber, fluorine rubber or acrylic rubber, for example.

It should be noted that the above-noted elasticity should be a Young's modulus of at least 0.1 MPa and at most 1.0 MPa. If the Young's modulus is less than 0.1 MPa, then its flexibility becomes too large, so that it becomes difficult to hold it in form of a belt, and it becomes difficult to handle during assembly and manufacture. On the other hand, if the Young's modulus is greater than 1.0 MPa, then the tensile force for attaining the desired elongation becomes too large, so that the constituent members for stretching the endless belt, such as the driven roller 47, need to be provided with greater strength. Consequently, those members need to be made larger to ensure the necessary strength. As for the above-noted conductivity, the volume resistivity should be not greater than $1.0\times10^7$ O·cm.

The driving roller 46 is rotationally driven by a motor (not shown in the drawings), and transmits a driving force to the endless belt 43 at a driving transmission position 43C where it is in contact with the endless belt 43. The driving roller 46 is made of a metal such as stainless steel. It should be noted that the driving roller 46 and the motor are driving devices in the sense of the present invention. The driven roller 47, which follows the rotation of the endless belt 43, is made of a metal such as aluminum. A voltage is applied to the two rollers 46 and 47, and the endless belt 43 is held at a predetermined developing potential.

The layer regulating blade 44, which is made of stainless steel, is 100 μm thick and the length of the layer regulating blade 44 is 10 mm. The layer regulating blade 44 presses against the driven roller 47 at a pressure contact region 43B, with the endless belt 43 being disposed between the layer regulating blade 44 and the driven roller 47. Furthermore, the layer regulating blade 44 charges the toner T by friction, while regulating the layer thickness of the toner T that is carried by the endless belt 43 at the pressure contact region 43B.

The recovery seal 45 is made of urethane rubber, and provides a seal between the lower edge of the aperture portion of the toner hopper 41 and the surface of the endless belt 43. The recovery seal 45 further prevents toner T from flowing out of the toner hopper 41.

Figure 3:
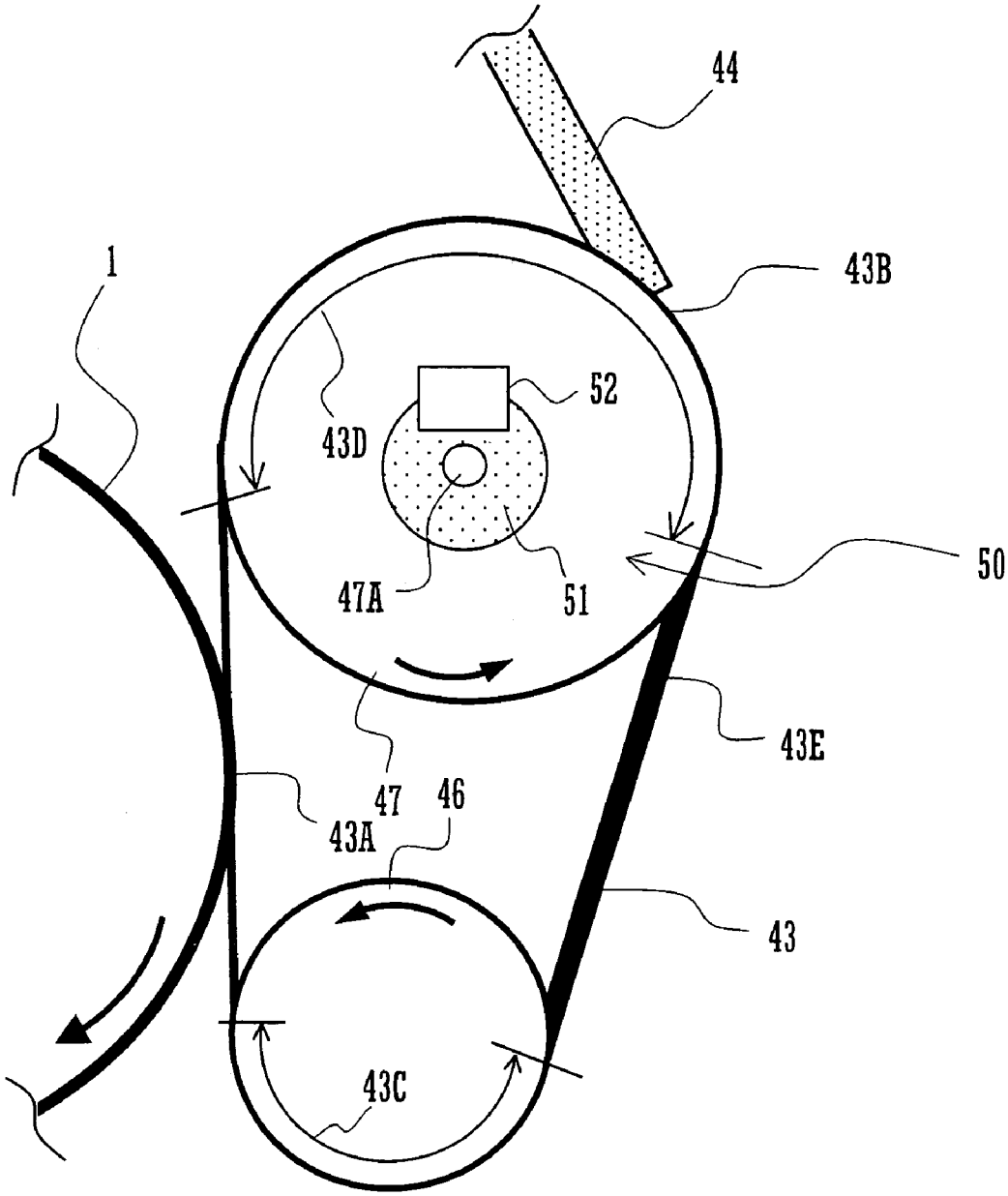
FIG. 3 is a lateral cross-sectional surface showing the configuration of a portion of the developing device according to an embodiment of the present invention.

FIG. 3 is a lateral cross-sectional surface showing the configuration of a portion of the developing device according to an embodiment of the present invention. FIG. 3 shows the state during an image formation operation. As shown in FIG. 3, the following roller 47 is provided with a braking device 50 disposed on a rotation shaft 47A. This braking device 50 is made of a disk 51 and a friction pad 52 or the like, and applies a rotational load on the driven roller 47. The disk 51 is fitted onto the rotation shaft 47A. The friction pad 52 abuts against the disk 51. By using the braking device 50, it is possible to apply a consistent rotational load that is independent of the rotational phase of the rotation shaft 47A. Moreover, the rotational load due to the braking device 50 is transmitted from the driven roller 47 to the endless belt 43 at a rotational driving load transmission position 43D.

As shown in FIG. 3, in order to overcome the driving load applied at the rotational driving load transmission position 43D, the endless belt 43 is expanded at least at a contact region 43A at which a tensional force is acting due to the driving of the belt at the driving transmission position 43C, whereas the endless belt 43 is contracted at least at the pressure contact region 43B and a developing agent supply region 43E where the tensional force is slackened. Due to this extending/contracting action, the layer thickness of the developing agent at the contact region 43A is caused to be thinner than the layer thickness of the developing agent that is regulated at the pressure contact region 43B.

Note that for the braking device 50 according to the present embodiment of the invention, a configuration using the disk 51 and the friction pad 52 is used, but there is no limitation to this. For example, it is also possible to apply a configuration in which a wire is wrapped around the rotation shaft.

When the image formation operation in accordance with the supplied image information is started, the surface of the rotating photosensitive drum 1 is first charged uniformly to −600V by the charge roller 2. Next, the exposure member 3 exposes the surface of the photosensitive drum 1 in accordance with the image information, thus forming a static latent image. It should be noted that the exposure potential of the exposure member 3 may be −70 V, for example.

Then, at the contact region 43A, the static latent image is developed by supplying the charged toner T on the peripheral surface of the endless belt 43, which has been charged to a predetermined developing potential (for example −300 V) to the surface of the photosensitive drum 1. Next, the transfer roller 5 transfers the toner image that is formed on the surface of the photosensitive drum 1 onto the paper P.

The developing device 4, which supplies the toner T to the photosensitive drum 1 during this image forming operation, transports unused toner T within the toner hopper 41 to the endless belt 43 by rotating the toner supply roller 42. Next, the toner T carried on the peripheral surface of the endless belt 43 is transported to the pressure contact region 43B, excess toner T is scraped off by the pressure of the layer regulating blade 44, thus regulating (making thin) the layer thickness of the toner T and frictionally charging the toner T. It should be noted that in this embodiment of the present invention, the toner amount per surface area of the endless belt 43 (the transported amount of toner T) in this situation is 0.7 mg/cm$^2$. This toner amount is too much compared to the toner amount per surface area that is required for attaining the prescribed image concentration, namely 0.45 mg/cm$^2$.

After this, the toner T whose layer thickness has been regulated is transported to the contact region 43A, but at this contact region 43A, the endless belt 43 is expanded, so that also the toner T whose layer thickness has been regulated is accordingly transported to the contact region 43A in a state in which its layer thickness has become thinner. With the contact region 43A in the present embodiment of the invention, the elongation of the endless belt 43 is about 100%, so that its length is expanded to twice the length of its regular unexpanded state. Consequently, the amount of toner T carried on the endless belt 43 becomes half the amount of that after passing the pressure contact region 43B, namely 0.35 mg/cm$^2$. Therefore, the amount of toner T that is transported to the contact region 43A is less than the amount that is necessary for developing, but since the rotation speed of the endless belt 43 is faster than the rotation speed of the photosensitive drum 1, a transport amount of the toner T that is suitable for attaining the prescribed density can be achieved.

Moreover, due to the sliding action of the surface of the photosensitive drum 1 against the toner T achieved by the circumferential speed difference, it is possible to attain the effect that the endless belt 43 scrapes off the toner T adhering to non-image regions on the surface of the photosensitive drum 1. As a result, fogging does not occur during development, the toner density can be made uniform, and images of excellent quality even for very thin lines can be formed on paper.

It should be noted that the rotation speed of the endless belt 43 in the present embodiment of the invention is set to a speed (150 mm/s) at the contact region 43A that is 1.5 times the rotation speed of the photosensitive drum 1 (100 mm/s).

Moreover, in the present embodiment of the invention, the elongation of the endless belt 43 at the contact region 43A is set to 100%, but it is preferable that this elongation is at least 30% and at most 200%. If the elongation is less than 30%, then the change in the thickness of the endless belt 43 becomes too small, so that also the change of the transported amount of toner T becomes accordingly too small. On the other hand, if the elongation is more than 200%, then there is the risk that the endless belt 43 ruptures due to the repeated expansion/contraction. It is preferable to set this upper limit for the elongation to not greater than one about third of the maximum elongation of the material forming the endless belt 43. It should be noted that the endless belt 43 of the present embodiment of the invention is made of urethane rubber which has a maximum elongation of 600%.

After passing the contact region 43A, the driving force is transmitted to the endless belt 43 at the driving transmission position 43C. After that, the endless belt 43 again reaches a location where it contacts the toner supply roller 42, but after passing the driving transmission position 43C, it is in a state in which its thickness has increased. In this state, the endless belt 43 passes the recovery seal 45, carrying the toner T that has not been supplied to the photosensitive drum 1 and rubs against the toner supply roller 42 within the toner hopper 41. Thus, the toner T on the peripheral surface of the endless belt 43 is initialized (removed), while supplying unused toner T in the toner hoper 41. By repeating the above operation, the toner T is successively supplied to the photosensitive drum 1.

Note that in the present embodiment of the invention, the photosensitive drum 1 and the endless belt 43 rotate in the same direction at the contact region 43A, but they may also rotate in opposite directions. Thus, the effect of scraping off the toner T at the contact region 43A can be enhanced. Moreover, the toner T is rubbed by the photosensitive drum 1 and the endless belt 43 at the contact region 43A, thereby enhancing its frictional charging. Thus, it is possible to adequately charge toner T that has not been adequately charged at the pressure contact region 43B. Consequently, it is possible to suppress fogging during development, and to attain image formation of excellent image quality on paper even for resolutions with very thin lines.

With the above-described configuration, the layer thickness of the toner T carried on the peripheral surface of the endless belt 43 can be made thin by utilizing the changes in the thickness of the endless belt 43. Therefore, it is not necessary to regulate the layer thickness of the toner T on the peripheral surface of the endless belt 43 using only the layer regulating blade 44, as in conventional configurations, and it is possible to reduce the contact pressure of the layer regulating blade 44 on the endless belt 43 to a pressure that is lower than in conventional configurations.

Thus, while sustaining a layer thickness of the toner T carried on the peripheral surface of the endless belt at the contact region 43A that is suitable for development, it is possible to prevent deterioration of the toner T due to the layer regulating blade 44 and to prevent fusing of the toner T to the layer regulating blade 44.

Moreover, the contact pressure of the layer regulating blade 44 can be stabilized, because the layer regulating blade 44 presses against the endless belt 43 at the pressure contact region 43B above the region where the inner side of the endless belt 43 is stretched over the driven roller 47. Therefore, the contact pressure of the layer regulating blade 44 can be adequately transmitted to the endless belt 43, so that the layer thickness of the toner carried on the peripheral surface of the endless belt 43 can be regulated consistently.

It should be noted that in the present embodiment of the invention, the layer regulating blade 44 presses against the driven roller 47 via the endless belt 43, but there is no limitation to this, and the same effect as explained above can be attained as long as it presses against a support member over which the endless belt 43 is suspended within the region 43B.

Moreover, in the present embodiment of the invention, the driven roller 47 to which a load is applied is included as a load device, but it is also possible to use a support member that is a fixed member and that generates friction at a contact region with the endless belt 43. Thus, it is possible to attain the same effect as with the above configuration. Moreover, with such a configuration, it is possible to omit the braking device 50 or the member for rotation support, such as the bearings, so that it is possible to avoid an increase in cost for the developing device 4.

Furthermore, the layer regulating blade 44 does not have to abut against a support member, such as the driven roller 47, and it is sufficient if it is at a position upstream, with respect to the rotation direction of the endless belt 43, from the position where a load is applied to the endless belt 43, and downstream, with respect to the rotation direction of the endless belt 43, from the position of the toner supply roller.

Furthermore, in the present embodiment of the invention, a braking device 50 is provided, but there is no particular limitation to this and it is possible to attain a similar effect as above, as long as a load acting in the direction opposite to the rotation direction of the endless belt 43 can be applied to the endless belt 43 via the driven roller 47. An example of this is a configuration in which the rotation shaft 47A is provided with a torque limiter.

Second Embodiment

Figure 4:
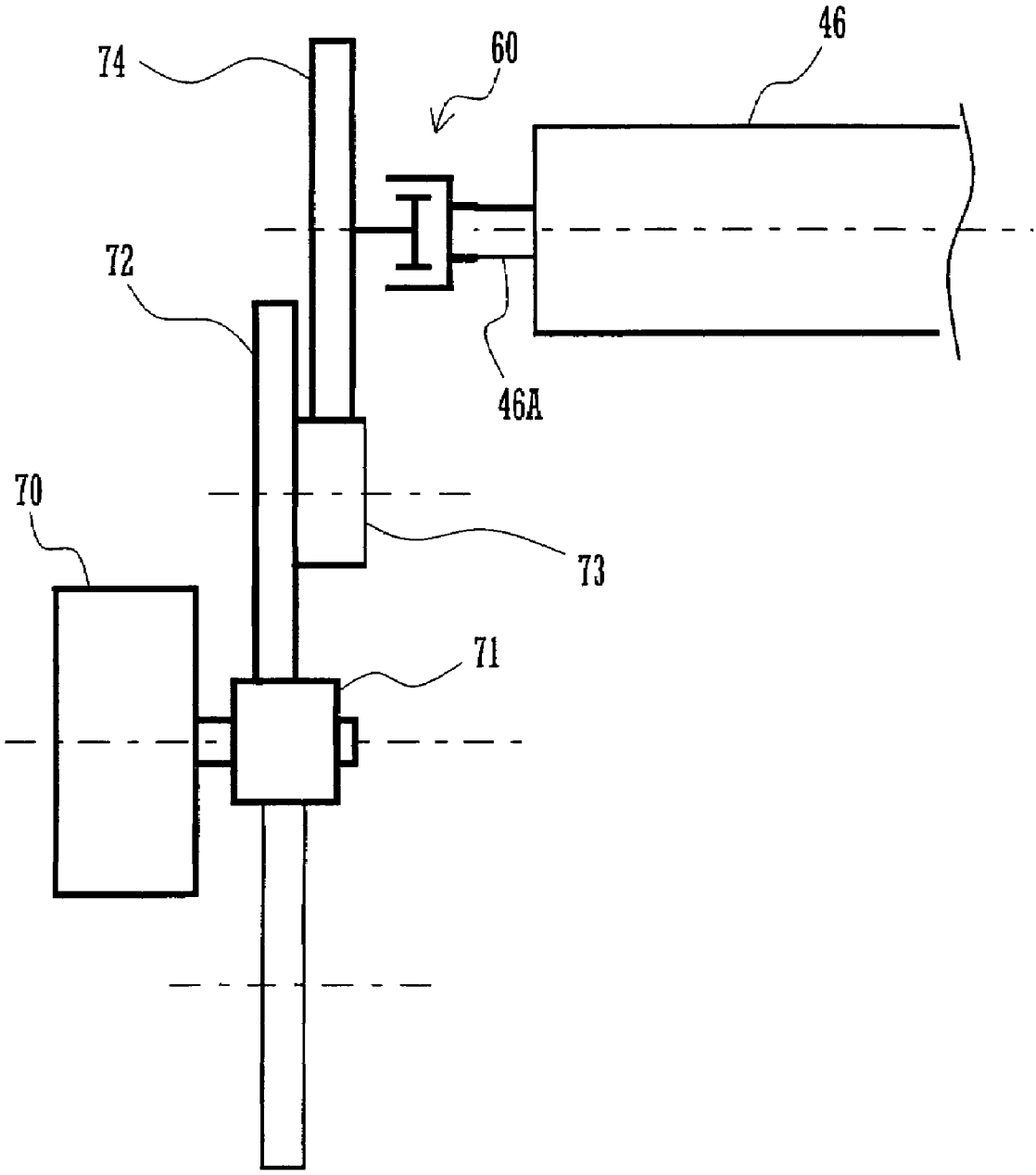
FIG. 4 is plan cross-sectional view showing the configuration of a portion of an image forming apparatus provided with a developing device according to another embodiment of the present invention.

FIG. 4 is plan cross-sectional view showing the configuration of a portion of an image forming apparatus provided with a developing device according to another embodiment of the present invention. This embodiment of the present invention has substantially the same configuration as the first embodiment, but a rotation shaft 46A of the driving roller 46 is provided with a centrifugal clutch 60.

In a stand-by state in which no image forming operation is performed, the motor 70 does not rotate, so that if, for example, a pulse motor or the like is used as the motor 70, then the rotation shaft of the motor 70 is held fixed when not in operation. Consequently, if there were no centrifugal clutch 60, the driver roller 46 would be in a fixed state in which it cannot rotate at times other than during image formation. Therefore, the endless belt 43 would be always in an expanded/contracted state in which a load is applied on it.

Accordingly, in this embodiment, the motor 70 is connected via a motor gear 71, intermediate gears 72 and 73, and a roller gear 74 to the input side of the centrifugal clutch 60. Moreover, the rotation shaft 46A of the driving roller 46 is connected to the output side of the centrifugal clutch 60. During rotation of the motor 70, the centrifugal clutch 60 does not transfer the rotational driving force suddenly to the driving roller 46, but instead transmits it gradually as the rotation speed of the motor 70 increases. Consequently, at times when the endless belt 43 is not rotationally driven and no image formation is performed, the driving roller 46 and the motor 70 are in a state in which they are not connected by the centrifugal clutch 60, so that the driving roller 46 becomes freely rotatable. Accordingly, the endless belt 43, whose thickness varied from location to location due to its expansion and contraction, can be returned to a uniform thickness through its own elasticity, so that creep deformations of the endless belt 43 can be prevented and a long lifetime can be achieved.

It should be noted that in the present embodiment of the invention, the driving roller 46 is rotationally driven via the centrifugal clutch 60, but there is no limitation to this, and it is also possible to use an electromagnetic clutch that operates only when the motor 70 is rotationally driven or a coupling with a lot of play in the rotation direction.

Moreover, the driving roller 46 is freely rotatable while no image formation is performed, but it is also possible to attain a similar effect as above when the driven roller 47 is freely rotatable instead of the driving roller 46. For example, it is possible to provide the braking device 50 with an adjustment portion including a control means and a contact force detection means for adjusting the contact force applied by the friction pad 52 on the disk 51, and to take away the contact pressure applied by the friction pad 52 on the disk 51 while no image formation is performed. Moreover, by providing an adjustment portion, it is possible to make automatic adjustments when the contact force has changed due to long years of use.

Figure 5:
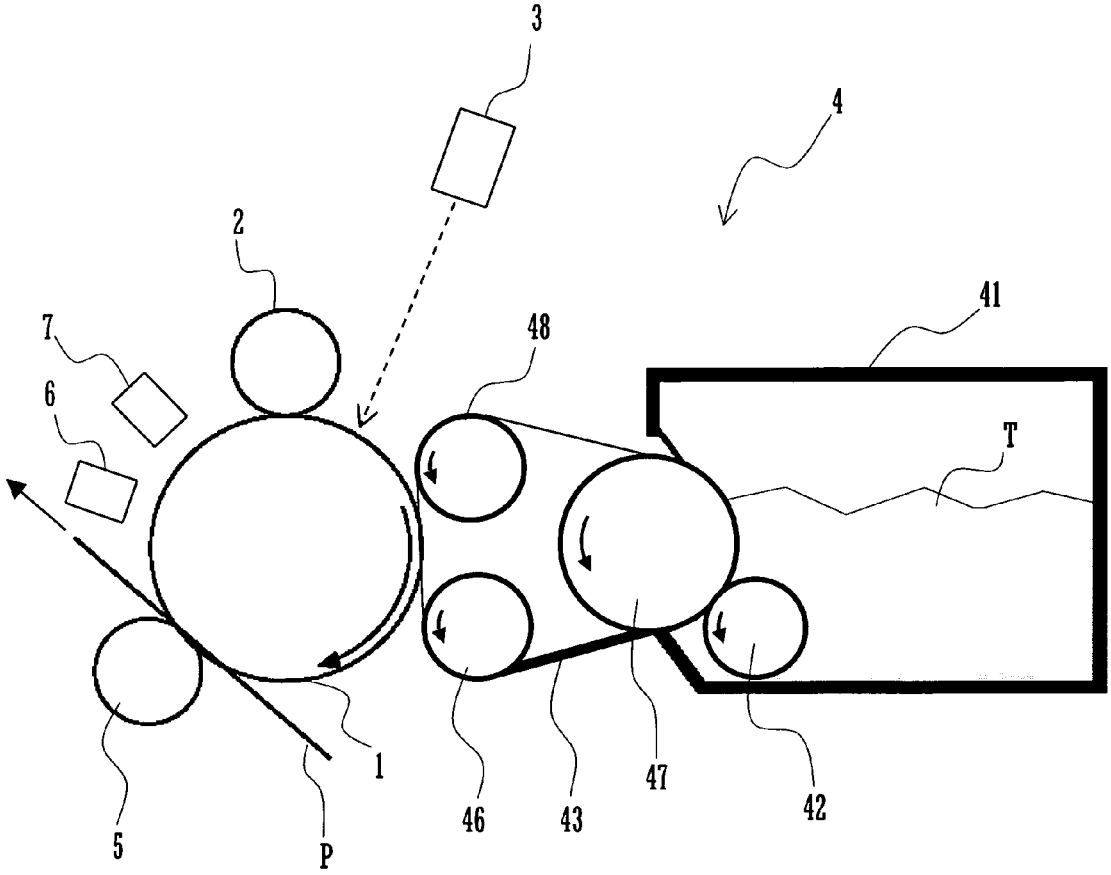
FIG. 5 is a lateral cross-sectional view showing the configuration of a portion of an image forming apparatus provided with a developing device according to another embodiment of the present invention.

It should be noted that in the above-described first and second embodiments, a driving roller 46 and a driven roller 47 were used as the support members over which the endless belt 43 is stretched, but there is no limitation to this and it is possible to use any configuration using a plurality of support members. As shown in FIG. 5, it is also possible to attain a similar effect as above when a support roller 48 is used to span the endless belt 43 with a total of three support members. It should be noted that when there are fewer support members, there is the advantage that the configuration is simpler and more compact. Moreover, in configurations using a support roller 48 as shown in FIG. 5, it is also possible to attain a similar effect as above when the rotation load is applied to the support roller 48 instead of to the driven roller 47.

Furthermore, the layer regulating blade 44 is used as a layer regulating member in the foregoing embodiments, but there is no particular limitation to this. For example, other possible configurations are configurations using metal rods or metal plates that are stiff and have a polygonal profile, or rollers that are pressed against the endless belt 43 and rotate in the direction opposite to the rotation direction of the endless belt.

It should be noted that in the present embodiment of the invention, the pigment density of the toner T is a high density of 15%, and it is preferable that the pigment density is at least 7% and at most 20%. A toner T with a high pigment density is easily deteriorated by applying a load, but in the present embodiment, the contact pressure (load) applied by the layer regulating blade 44 on the toner T at the pressure contact region 43B is smaller than in the conventional art. Consequently, it is possible to use toner T with a high pigment concentration and the consumption amount of the toner T can be reduced, so that the toner hopper 41 can be made smaller and a longer lifetime can be realized.

When the pigment density is made larger than 20%, then the pigments may not be compatible with the resin serving as the base of the toner T, so that the fixing force after fixation may be insufficient, and the toner is easily crushed by the contact pressure applied by the layer regulating blade 44 at the pressure contact region 43B. In this case, even in a configuration using an endless belt 43 with an elongation of 200% with which the contact pressure force of the layer regulating blade 44 can be minimized so that the toner T is crushed as little as possible, the time until fusion occurs during continuous rotation becomes less than a reference for judging durability(10 hours), and an adequate image quality cannot be sustained.

On the other hand, when the pigment density is less than 7%, then the amount of toner supplied to the photosensitive drum 1 in order to attain the prescribed image density must be made large. Therefore, even with a configuration using an endless belt 43 with an elongation of 30% with which the toner transport amount after passage of the pressure contact region 43B becomes minimal, although the time until the time until fusion occurs during continuous rotation exceeds the reference, and it is not necessary to use an expanding and contracting endless belt 43, but it is not possible to reduce the consumed amount of toner T.

Moreover, with the present embodiment of the invention, the volume average particle size of the toner T is set to 6.5 μm, and it is preferable that the volume average particle size of the toner T is at least 4 μm and at most 8 μm. By using toner with such a small particle diameter, the coverage of the paper P for the same toner mass per unit surface area is increased, so that the amount of toner T adhering to the photosensitive drum 1 can be decreased while improving the image quality and reducing the amount of toner consumed. Thus, while ensuring an adequate image density, there is little scattering of toner T, and faithful and sharp thin lines can be developed in the static latent image. Toner T with a particle diameter in the above range has a low flowability so that it is easily deteriorated by applying a load, but in accordance with the present embodiment, the contact pressure applied by the layer regulating blade 44 on the toner T at the pressure contact region 43B is smaller than in the conventional art, so that consistent images can be formed for long periods of time.

If the particle size of the toner T exceeds 8 μm, then fusion becomes more difficult while the toner amount for attaining the prescribed image density is increased. Therefore, even in configurations using an endless belt 43 with an elongation of 30% with which the toner transport amount after passage of the pressure contact region 43B becomes minimal, the time until fusion occurs during continuous rotation exceeds the reference, and it is not necessary to use an expanding and contracting developing endless belt 43, but it is not possible to realize a higher image quality and a reduction of the toner consumption amount while reducing the amount of toner T adhering to the photosensitive belt 1.

On the other hand, when the particle size of the toner T becomes less than 4 μm, the toner T may easily fuse to the layer regulating blade 44 due to the load applied by the layer regulating blade 44. Therefore, even in a configuration using an endless belt 43 with an elongation of 200% with which the contact pressure force of the layer regulating blade 44 can be minimized, the time until fusion occurs during continuous rotation becomes less than the reference.

Furthermore, in accordance with the embodiments of the invention, a low temperature fixing toner with a softening point temperature of 100° C. is used, and it is preferable to use a low temperature fixing toner with a softening point temperature of at least 95° C. and at most 120° C. By using a low temperature fixing toner in this range, it is possible to achieve energy savings as well as faster speeds. Low temperature fixing toners tend to deteriorate when a load is applied to them, but in accordance with the present embodiment, the contact pressure applied by the layer regulating blade 44 on the toner T at the pressure contact region 43B is smaller than in the conventional art, so that it is possible to form consistent images over a long period of time even when using a low temperature fixing toner.

Moreover, in accordance with the embodiments of the present invention, a toner T whose content of wax serving as the release agent is 12% is used, and it is preferable that the content of wax in the toner T is at least 6% and at most 20%. By using a toner T with a wax content in this range, it is possible to ensure adequate release properties during the fixation of the toner T on the paper. Consequently, it becomes unnecessary to supply release agents, such as oil or the like, and the image forming apparatus can be made more compact. Toner T including wax tends to deteriorate when a load is applied to it, but in accordance with the present embodiment, the contact pressure applied by the layer regulating blade 44 on the toner T at the pressure contact region 43B is smaller than in the conventional art, so that it is possible to form consistent images over a long period of time even when using a low temperature fixing toner.

Moreover, as the method for fabricating the toner T, it is possible to disperse the coloring pigment and the release agent and the like in a binder resin and mill the resulting mixture, but it is preferable to fabricate the toner T by a wet method, for which emulsion polymerization, suspension polymerization and solution-suspension polymerization are typical examples. Such wet methods have the advantage that it is easy to attain a particle shape that is spherical or close to spherical, and the toner's flowability can be controlled through process control. Through this control of the flowability, it is possible to adequately set the amount of toner that is carried by the photosensitive drum 1. Thus, it becomes easy to consistently attain an adequate image density.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A developing device comprising:

an endless belt that is stretched around a plurality of support members, a portion of a peripheral surface of the endless belt contacting a portion of a surface of an image carrying member at a contact region, and the endless belt being rotated by a driving force that is transmitted from a driving device at a driving transmission position; and a layer regulating member that is pressed against a portion of the endless belt at a pressure contact region positioned upstream, with respect to the endless belt's rotation direction, from the contact region;

wherein a single component developing agent carried on a peripheral surface of the endless belt is supplied to the contact region, the agent being provided to the peripheral surface at a predetermined region;

wherein the contact region is positioned upstream, with respect to the endless belt's rotation direction, from the driving transmission position; and wherein the developing device is further provided with a load device applying, to at least a portion of the endless belt between the pressure contact region and the contact region, a load acting in a direction opposite to the rotation direction of the endless belt so that the endless belt is thinner at the contact region than at the predetermined region.

2. The developing device according to claim 1, wherein the load device includes at least one of the support members.

3. The developing device according to claim 2, wherein the support member included in the load device is a driven roller that rotates following the endless belt, and a rotational load acts on that driven roller.

4. The developing device according to claim 3, wherein the load device includes an adjustment portion for adjusting the rotational load.

5. The developing device according to claim 1, wherein the layer regulating member presses via the endless belt against one of the support members.

6. The developing device according to claim 1, wherein the driving device includes one of the support members; and wherein the support member included in the driving device is a driving roller that rotationally drives the endless belt, and that is freely rotatable when rotational driving is halted.

7. An image forming apparatus performing image formation by transferring onto a recording medium a developing agent image obtained by developing a static latent image formed on a surface of an image carrying member, the image forming apparatus comprising:

a developing device comprising:

an endless belt that is stretched around a plurality of support members, a portion of a peripheral surface of the endless belt contacting a portion of a surface of the image carrying member at a contact region, and the endless belt being rotated by a driving force that is transmitted from a driving device at a driving transmission position; and a layer regulating member that is pressed against a portion of the endless belt at a pressure contact region positioned upstream, with respect to the endless belt's rotation direction, from the contact region;

wherein a single component developing agent carried on a peripheral surface of the endless belt is supplied to the contact region, the agent being provided to the peripheral surface at a predetermined region;

wherein the contact region is positioned upstream, with respect to the endless belt's rotation direction, from the driving transmission position; and wherein the developing device is further provided with a load device applying, to at least a portion of the endless belt between the pressure contact region and the contact region, a load acting in a direction opposite to the rotation direction of the endless belt so that the endless belt is thinner at the contact region than at the predetermined region.

8. The image forming apparatus according to claim 7, wherein the load device includes at least one of the support members.

9. The image forming apparatus according to claim 8, wherein the support member included in the load device is a driven roller that rotates following the endless belt, and a rotational load acts on that driven roller.

10. The image forming apparatus according to claim 9, wherein the load device includes an adjustment portion for adjusting the rotational load.

11. The image forming apparatus according to claim 7, wherein the layer regulating member presses via the endless belt against one of the support members.

12. The image forming apparatus according to claim 7, wherein the driving device includes one of the support members; and wherein the support member included in the driving device is a driving roller that rotationally drives the endless belt, and that is freely rotatable when rotational driving is halted.

13. A developing device comprising:

an endless belt that is stretched around a plurality of support members, a portion of a peripheral surface of the endless belt contacting a portion of a surface of an image carrying member at a contact region, and the endless belt being rotated by a driving force that is transmitted from a driving device at a driving transmission position; and a layer regulating member that is pressed against a portion of the endless belt at a pressure contact region positioned upstream, with respect to the endless belt's rotation direction, from the contact region;

wherein a single component developing agent carried on a peripheral surface of the endless belt is supplied to the contact region;

wherein the contact region is positioned upstream, with respect to the endless belt's rotation direction, from the driving transmission position;

wherein the developing device is further provided with a load device applying, to at least a portion of the endless belt between the pressure contact region and the contact region, a load acting in a direction opposite to the rotation direction of the endless belt;

wherein the load device includes at least one of the support members;

wherein the support member included in the load device is a driven roller that rotates following the endless belt, and a rotational load acts on that driven roller; and wherein the load device includes an adjustment portion for adjusting the rotational load.

14. A developing device comprising:

an endless belt that is stretched around a plurality of support members, a portion of a peripheral surface of the endless belt contacting a portion of a surface of an image carrying member at a contact region, and the endless belt being rotated by a driving force that is transmitted from a driving device at a driving transmission position; and a layer regulating member that is pressed against a portion of the endless belt at a pressure contact region positioned upstream, with respect to the endless belt's rotation direction, from the contact region;

wherein a single component developing agent carried on a peripheral surface of the endless belt is supplied to the contact region;

wherein the contact region is positioned upstream, with respect to the endless belt's rotation direction, from the driving transmission position;

wherein the developing device is further provided with a load device applying, to at least a portion of the endless belt between the pressure contact region and the contact region, a load acting in a direction opposite to the rotation direction of the endless belt;

wherein the driving device includes one of the support members; and wherein the support member included in the driving device is a driving roller that rotationally drives the endless belt, and that is freely rotatable when rotational driving is halted.

15. An image forming apparatus performing image formation by transferring onto a recording medium a developing agent image obtained by developing a static latent image formed on a surface of an image carrying member, the image forming apparatus comprising:

a developing device comprising:

an endless belt that is stretched around a plurality of support members, a portion of a peripheral surface of the endless belt contacting a portion of a surface of the image carrying member at a contact region, and the endless belt being rotated by a driving force that is transmitted from a driving device at a driving transmission position; and a layer regulating member that is pressed against a portion of the endless belt at a pressure contact region positioned upstream, with respect to the endless belt's rotation direction, from the contact region;

wherein a single component developing agent carried on a peripheral surface of the endless belt is supplied to the contact region;

wherein the contact region is positioned upstream, with respect to the endless belt's rotation direction, from the driving transmission position;

wherein the developing device is further provided with a load device applying, to at least a portion of the endless belt between the pressure contact region and the contact region, a load acting in a direction opposite to the rotation direction of the endless belt;

wherein the load device includes at least one of the support members;

wherein the support member included in the load device is a driven roller that rotates following the endless belt, and a rotational load acts on that driven roller; and wherein the load device includes an adjustment portion for adjusting the rotational load.

16. An image forming apparatus performing image formation by transferring onto a recording medium a developing agent image obtained by developing a static latent image formed on a surface of an image carrying member, the image forming apparatus comprising:

a developing device comprising:

an endless belt that is stretched around a plurality of support members, a portion of a peripheral surface of the endless belt contacting a portion of a surface of the image carrying member at a contact region, and the endless belt being rotated by a driving force that is transmitted from a driving device at a driving transmission position; and a layer regulating member that is pressed against a portion of the endless belt at a pressure contact region positioned upstream, with respect to the endless belt's rotation direction, from the contact region;

wherein a single component developing agent carried on a peripheral surface of the endless belt is supplied to the contact region;

wherein the contact region is positioned upstream, with respect to the endless belt's rotation direction, from the driving transmission position;

wherein the developing device is further provided with a load device applying, to at least a portion of the endless belt between the pressure contact region and the contact region, a load acting in a direction opposite to the rotation direction of the endless belt;

wherein the driving device includes one of the support members; and wherein the support member included in the driving device is a driving roller that rotationally drives the endless belt, and that is freely rotatable when rotational driving is halted.

* * * * *